US009755315B2

(12) United States Patent
Xie et al.

(10) Patent No.: US 9,755,315 B2
(45) Date of Patent: Sep. 5, 2017

(54) ANTENNA ARRANGEMENT

(75) Inventors: Wanbo Xie, Beijing (CN); Jie Zhang, Espoo (FI); Wei He, Beijing (CN)

(73) Assignee: Nokia Technologies Oy, Espoo (FI)

( * ) Notice: Subject to any disclaimer, the term of this patent is extended or adjusted under 35 U.S.C. 154(b) by 696 days.

(21) Appl. No.: 13/984,624

(22) PCT Filed: Feb. 10, 2011

(86) PCT No.: PCT/CN2011/070905
§ 371 (c)(1),
(2), (4) Date: Aug. 9, 2013

(87) PCT Pub. No.: WO2012/106839
PCT Pub. Date: Aug. 16, 2012

(65) Prior Publication Data

US 2013/0314287 A1 Nov. 28, 2013

(51) Int. Cl.
*H01Q 13/10* (2006.01)
*H01Q 1/48* (2006.01)
*H01Q 21/28* (2006.01)

(52) U.S. Cl.
CPC ..... *H01Q 13/106* (2013.01); *H01Q 1/48* (2013.01); *H01Q 21/28* (2013.01)

(58) Field of Classification Search
CPC ..... H01Q 13/106
USPC ..... 343/770
See application file for complete search history.

(56) References Cited

U.S. PATENT DOCUMENTS

| | | | | |
|---|---|---|---|---|
| 6,424,300 | B1 | 7/2002 | Sanford et al. | |
| 6,466,176 | B1 | 10/2002 | Maoz et al. | |
| 6,765,538 | B2 | 7/2004 | Fang | |
| 7,006,048 | B2 | 2/2006 | Chang | |
| 7,501,990 | B2 | 3/2009 | Stutzke | |
| 2006/0050002 | A1 * | 3/2006 | Wang | H01Q 13/106 343/767 |

(Continued)

FOREIGN PATENT DOCUMENTS

| | | | |
|---|---|---|---|
| CN | 1806367 | A | 7/2006 |
| JP | 11-163625 | A | 6/1999 |

(Continued)

OTHER PUBLICATIONS

Office action received for corresponding Chinese Patent Application No. 201180069738.8, dated Oct. 10, 2015, 5 pages of office action and 4 pages of office action translation Available.

(Continued)

*Primary Examiner* — Graham Smith
(74) *Attorney, Agent, or Firm* — Nokia Technologies Oy

(57) ABSTRACT

The Figures illustrate an apparatus 2 comprising: a conductive element 4 comprising an area of conductive material 5 defined by a plurality of edges 6, 7 including a first edge 7 wherein the conductive element 4 comprises an interior aperture 12 in the area of conductive material 5 and an elongate portion 20 defined by a gap 14 at the first edge 7 of the conductive element 4 and by at least a portion of the interior aperture 12. The apparatus 2 may comprise a further interior aperture in the area of conductive material and a second elongate portion defined by a second gap, by at least a portion of the interior aperture and by at least a portion of the further interior aperture.

17 Claims, 4 Drawing Sheets

(56) References Cited

U.S. PATENT DOCUMENTS

| | | | |
|---|---|---|---|
| 2007/0024515 | A1 | 2/2007 | Suh |
| 2009/0153411 | A1 | 6/2009 | Chiang et al. |

FOREIGN PATENT DOCUMENTS

| | | | |
|---|---|---|---|
| JP | 2003-188639 | A | 7/2003 |
| TW | 561647 | B | 11/2003 |
| TW | 591821 | B | 6/2004 |
| WO | 02/063713 | A2 | 8/2002 |
| WO | 2009/050670 | A1 | 4/2009 |

OTHER PUBLICATIONS

Office action received for corresponding Chinese Patent Application No. 201180069738.8, dated Apr. 3, 2015, 5 pages of office action and 4 pages of office action translation Available.

Lindberg et al., "Wideband Slot Antenna for Low-Profile Hand-Held Terminal Applications", Proceedings of the 9th European Conference on Wireless Technology, Sep. 10-12, 2006, pp. 403-406.

Office action received for corresponding Chinese Patent Application No. 201180069738.8, dated Sep. 3, 2014, 7 pages of office action and No English Language translation available.

International Search Report and Written Opinion received in corresponding Patent Cooperation Treaty Application No. PCT/CN2011/070905. Dated Nov. 24, 2011. 12 pages.

Office action received for corresponding Chinese Patent Application No. 201180069738.8, dated May 25, 2016, 3 pages of office action and 4 pages of office action translation Available.

* cited by examiner

ANTENNA ARRANGEMENT

RELATED APPLICATION

This application was originally filed as PCT Application No. PCT/CN2011/070905 filed Feb. 10, 2011.

TECHNOLOGICAL FIELD

Embodiments of the present invention relate to an antenna arrangement. In particular, they enable a planar conductive element to operate as an antenna.

BACKGROUND

An antenna is an apparatus that has a low input/output impedance at a particular operational bandwidth(s) and has a higher input/output impedance at other frequencies. The operational bandwidth is a frequency range over which an antenna can efficiently operate. Efficient operation occurs, for example, when the antenna's input/output impedance is greater than an operational threshold.

A radio frequency antenna will easily transmit and/or receive radio waves within its operational bandwidth.

It is desirable to reduce the impact an antenna has on an electronic device that houses the antenna. In particular, at the frequencies used for radio communication a radiator element of an antenna may be large compared to the size of the device.

A planar inverted F antenna (PIFA) addresses this problem. It excites a planar conductive element (e.g. a ground plane) which then acts as the radiator of the antenna. The existing printed wiring board of the electronic device may provide the planar conductive element. However, a PIFA typically requires an additional conductive element parallel to the ground plane at either the top or bottom end of the ground plane. The requirements for the size, spacing and positioning of this additional conductive element may be problematic.

According to various, but not necessarily all, embodiments of the invention there is provided an apparatus comprising: a conductive element comprising an area of conductive material defined by a plurality of edges including at least a first edge wherein the conductive ground plane element comprises:

a first interior aperture in the area of conductive material and a first elongate portion defined by a gap at the first edge of the conductive element and by at least a portion of the interior aperture; and a second interior aperture in the area of conductive material and a second elongate portion defined by a second gap, by at least a portion of the first interior aperture and by at least a portion of the second interior aperture.

According to various, but not necessarily all, embodiments of the invention there is provided an apparatus comprising: a conductive element comprising an elongate area of conductive material defined by a plurality of edges including at least one elongate edge wherein the conductive ground plane element comprises an interior aperture in the area of conductive material and an elongate portion defined by a gap at the elongate edge of the conductive ground plane and by at least a portion of the interior aperture; and a feed element.

According to various, but not necessarily all, embodiments of the invention there is provided an apparatus comprising: a conductive element comprising: a conductive ground plane element comprising an edge wherein the conductive ground plane element comprises an interior aperture in the conductive ground plane element and an elongate portion defined by a gap at the edge of the conductive ground plane and by at least a portion of the interior aperture; and a feed element adjacent to but separated from the elongate portion and separated from the conductive ground plane element.

According to various, but not necessarily all, embodiments of the invention there is provided an apparatus comprising: a conductive element comprising: a ground plane with an aperture adjacent an edge of the ground plane; and a feed configured to indirectly feed a closed-loop electric current path comprising portions of the ground plane adjacent the aperture to enable radio wave radiation by the ground plane.

BRIEF DESCRIPTION

For a better understanding of various examples of embodiments of the present invention reference will now be made by way of example only to the accompanying drawings in which:

FIG. 2A illustrates an example of the excitation element with a reactive component;

FIGS. 3A, 3B, 3C and 3D illustrate an example of how the excitation element 10 may be fed by a feed 16 such that electric current flows in the current path 24. In these figures the feed 16 is an indirect feed.

Figure 3A:
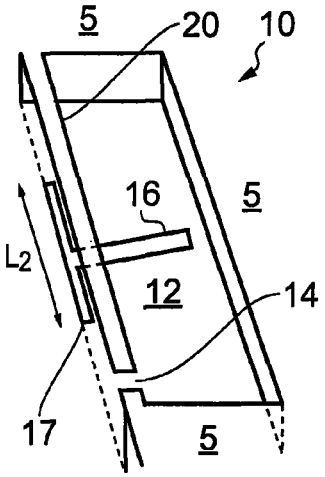
Figure 3B:
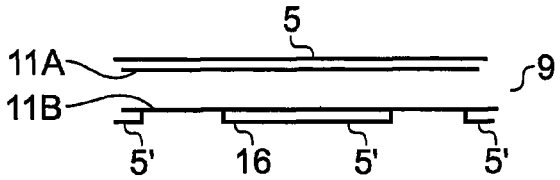
Figure 3C:
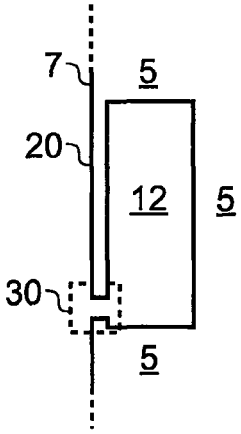
Figure 3D:
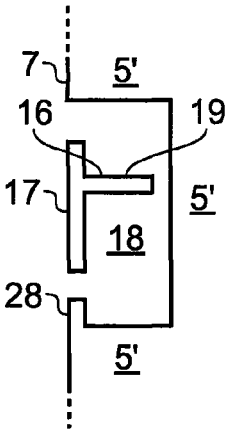
Figure 4:
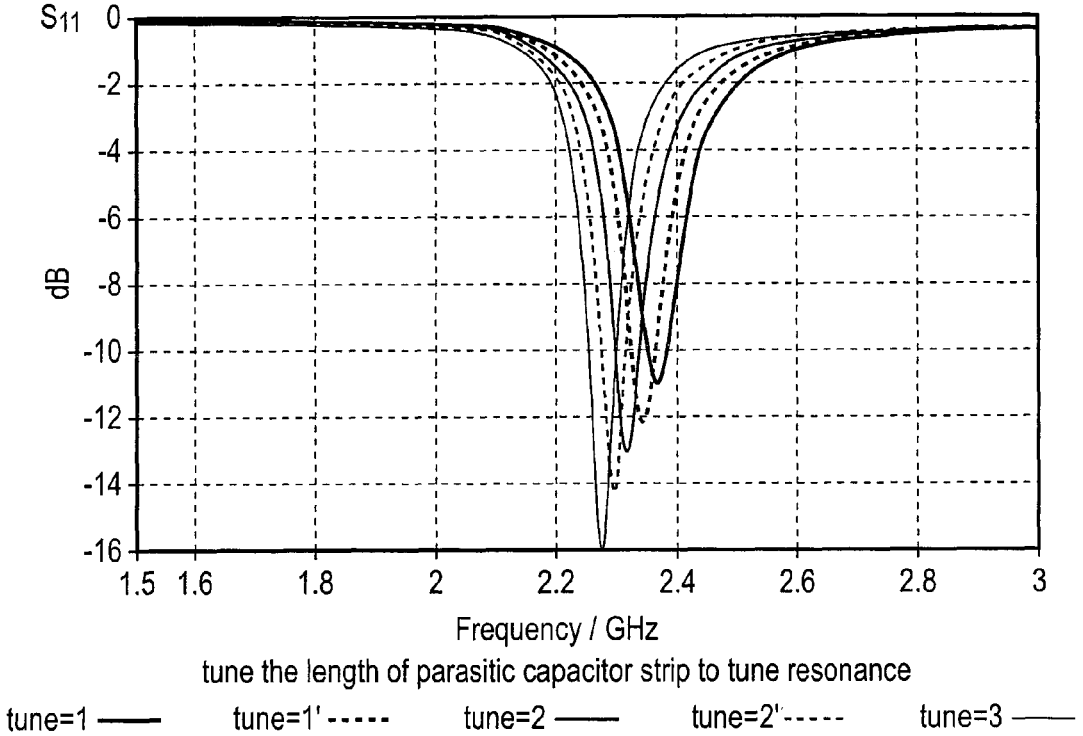
Figure 5:
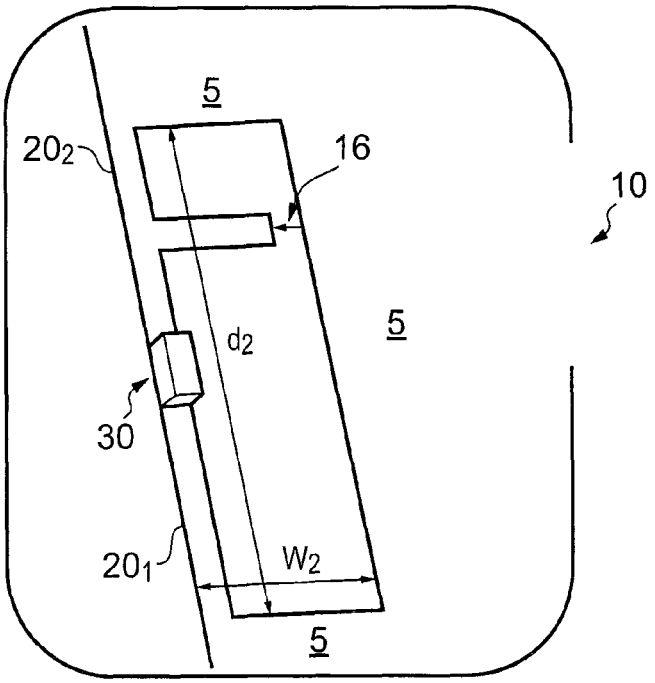
Figure 6B:
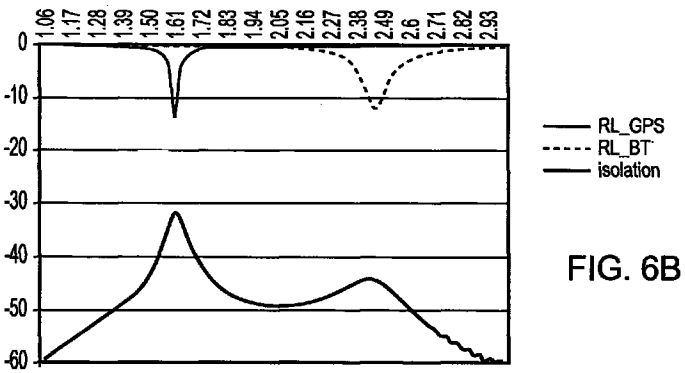
Figure 7A:
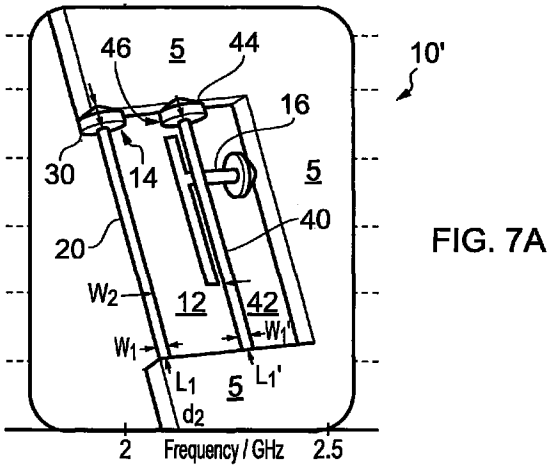
Figure 6A:
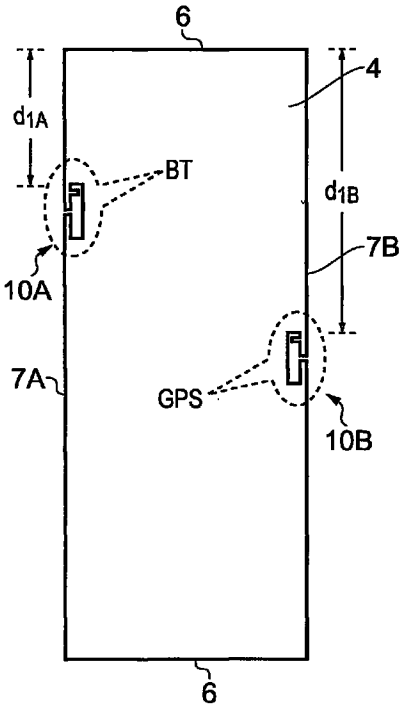
Figure 7B:
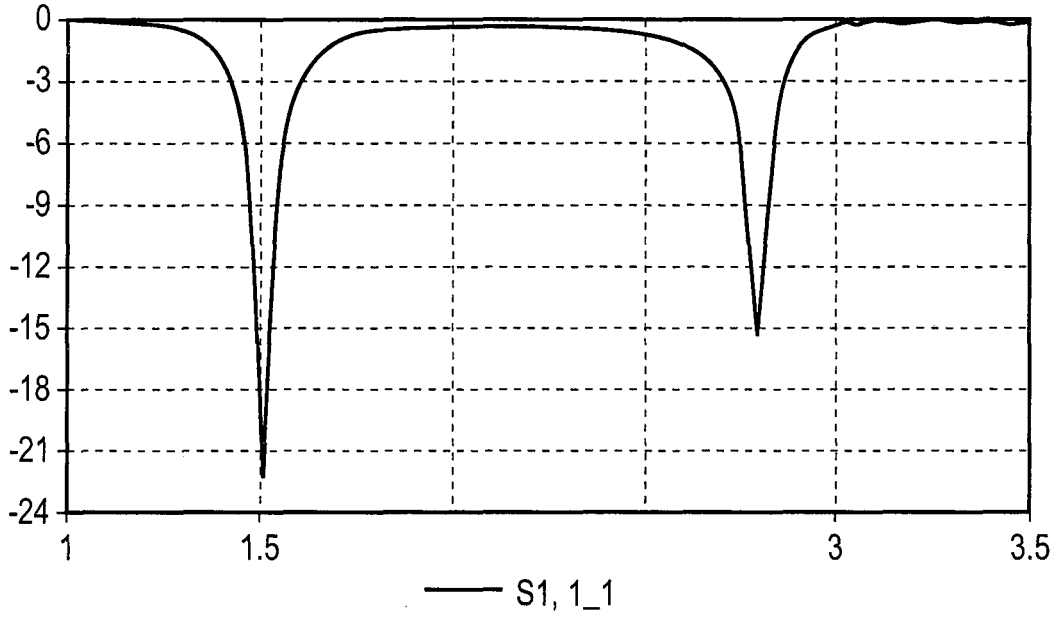
Figure 8:
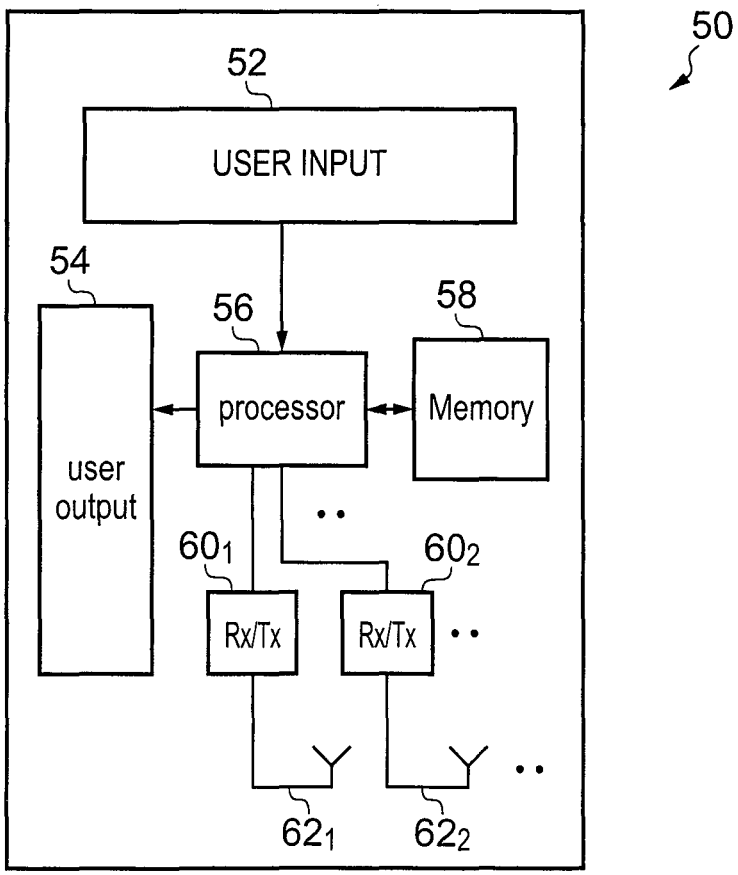

FIG. 3A is a perspective view of an example of an indirectly fed excitation element;

FIG. 3B is a side cross-sectional view of the example of an indirectly fed excitation element;

FIG. 3C is a top view of an upper layer of the example of an indirectly fed excitation element;

FIG. 3D is a top view of a lower layer of the example of an indirectly fed excitation element;

FIG. 4 illustrates how an insertion loss S11 of the example of the antenna varies with frequency;

FIG. 5 illustrates an alternative arrangement for providing a feed to the excitation element;

FIG. 6A illustrates an example of an apparatus that operates as a dual-band antenna;

FIG. 6B illustrates how an insertion loss S11 of the example of the dual-band antenna varies with frequency and also illustrates isolation;

FIG. 7A illustrates an example of another apparatus that operates as a dual-band antenna;

FIG. 7B illustrates how an insertion loss S11 of the example of the dual-band antenna varies with frequency; and FIG. 8 illustrates an electronic device.

DETAILED DESCRIPTION

The Figures illustrate an apparatus 2 comprising: a conductive planar element 4 comprising an area of conductive material 5 defined by a plurality of edges 6, 7 including a first edge 7 wherein the conductive planar element 4 comprises an interior non-conductive aperture 12 in the area of conductive material 5 and a conductive elongate portion 20 defined by a gap 14 at the first edge 7 of the conductive planar element 4 and by at least a portion of the interior aperture 12; and a feed element 16.

The apparatus 2 may comprise a further interior aperture in the area of conductive material and a second elongate portion defined by a second gap, by at least a portion of the interior aperture and by at least a portion of the further interior aperture.

The area of conductive material 5 may be elongate and the first edge may be an elongate edge.

The elongate portion 20 may be a thin elongate portion.

The apparatus 2 may comprise a feed element adjacent to but separated from the elongate portion and separated from the area of conductive material.

Figure 1:
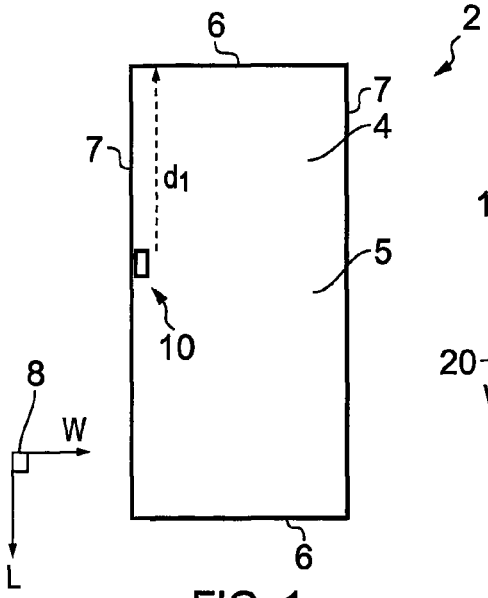
FIG. 1 illustrate an example of an antenna arrangement comprising a planar conductive element and an excitation element.

FIG. 1 illustrates an example of an apparatus 2 comprising: a conductive planar element 4 comprising an elongate area of conductive material 5. In this example, the elongate area is rectangular. As illustrated by the co-ordinate system 8, the rectangular area is defined at its sides by parallel elongate side edges 7 and defined at the top and bottom by shorter transverse edges 6. The elongate edges 7 extend lengthwise (L) and the transverse edges 6 extend widthwise (W).

In other exemplary embodiments the elongate area may be another shape other than rectangular, and may be any polygonal shape with more or less sides than the example rectangle, and may be formed in three dimensions. Further, the elongate area may comprise a plurality of portions of conductive material 5, where each portion is interconnected to form a unitary conductive material portion 5.

An excitation element 10 is positioned at a left side edge 7 of the conductive planar element 4 at a distance d1 from a top edge 6. The excitation element 10 enables the conductive planar element 4 to operate as an antenna radiator.

In alternative embodiments, the excitation element 10 may be positioned at the top edge 6 or a bottom edge of the conductive planar element.

The conductive planar element 4 may be flat and/or curved over at least a part of its overall area. The conductive planar element 4 may, for example, be formed around a supportive structure, for example a cover of the apparatus 2 or an additional non-conductive part. The conductive planar element 4 may or may not be curved where the excitation element 10 is located.

The conductive planar element 4 is configured to operate as an antenna radiator that has an operational bandwidth that covers a desired frequency or frequency range. Operational bandwidth is a frequency range over which an antenna can efficiently operate. Efficient operation occurs, for example, when the antenna's insertion loss S11 is greater than an operational threshold such as 4 dB or 6 dB. Examples of different operational bandwidths are illustrated in FIG. 4.

Operational bandwidth may, for example, include one or more of AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); lower cellular (824-960 MHz), US-GSM 850 (824-894 MHz); EGSM 900 (880-960 MHz); EU-WCDMA 900 (880-960 MHz); higher cellular (1710-2180 MHz), PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DR (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz); LTE 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz).

The conductive planar element 4 may be configured as a ground plane for a communications device 50 such as illustrated in FIG. 8.

Figure 2A:
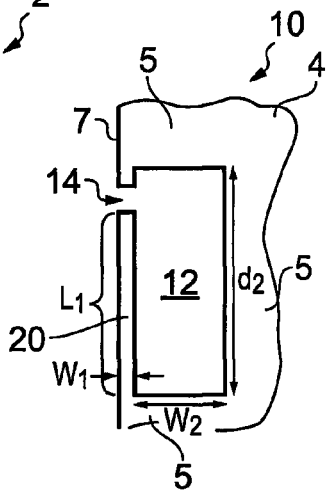
FIG. 2A illustrates an example of the excitation element without a reactive component.

FIG. 2A illustrates an example of the excitation element 10. The excitation element 10 comprises an interior aperture 12 in the conductive material 5 of the conductive planar element 4. The interior aperture 12 is positioned adjacent to the left side edge 7 and is an aperture that is wholly within the rectangular boundary of the conductive planar element 4 and is non-conductive.

A thin elongate portion 20 of conductive material 5 has a width w1 defined by the left elongate edge 7 of the conductive planar element 4 and by at least a portion of the interior aperture 12 and a length L1 defined by a gap 14 that extends from the interior aperture 12 through the conductive material 5 to the edge 7. The thin elongate portion 20, in this example, has a width w1 less than ⅕th the length L1. In this example, the width w1 is less than 1 mm.

The interior aperture 12 is in this example elongate. In this example it has a substantially rectangular perimeter having a length d2 and a width w2. The aperture has elongate sides that are parallel to the elongate sides 7 of the conductive planar element 4. The substantially rectangular perimeter has an outwardly extending notch to form the gap 14.

Although in this example embodiment the interior aperture 12 is illustrated having a rectangular shape, the interior aperture may have other shapes other than a rectangle, for example square, polygonal, circular, L-shaped, as several non-limiting examples.

The gap 14 prevents a galvanic/direct electric current flowing via the conductive material 5 along the elongate edge 7 of the conductive planar element 4. The gap 14 may be less than 2 mm.

The position of the gap 14 controls the length L1 of the thin elongate portion 20. In the illustrated example, the gap 14 is positioned to maximize the length L1 of the thin elongate portion 20.

Figure 2B:
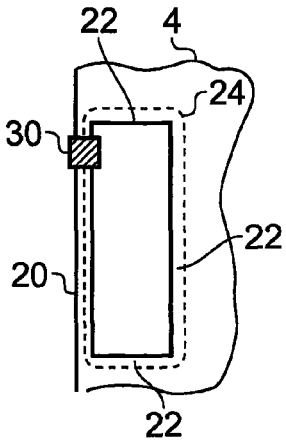

Referring to FIG. 2B a radio-frequency-electric-current path loop 24 is formed around the rectangular perimeter of the interior aperture 12. The loop is closed across the gap 14 either by the inherent capacitance of the gap 14 (if small enough for a predetermined operational frequency) or by the use of one or more reactive elements 30 to bridge the gap 14.

The electric current path loop 24 comprises the thin elongate portion 20 and portions 22 of the conductive planar element 4 that are adjacent to the interior aperture 12 and, optionally, at least one reactive element 30 bridging the gap 14.

The current path 24 has an electrical length of $\lambda/2$, where $\lambda$ is the resonant wavelength at which the apparatus 2 is operable as a radio frequency antenna.

The interior aperture 12 may have a perimeter that has a length less than (or more than) $\lambda/2$ with the reactive element 30 being used to adjust the electrical length of the current path 24 to substantially $\lambda/2$. By altering the area of the interior aperture 12, the perimeter length is thus altered, which in turn alters the resonant wavelength of the antenna.

For example, at least one reactive element 30 bridging the gap 14 may be capacitive and/or inductive. It may, for example comprise one or more lumped components. In the illustrated example, the reactive element 30 is a lumped capacitor which provides the advantage of forming a smaller interior aperture 12 and thus saves space used within the planar conductive element 4. The reactive element 30 may in addition provide tuning of the excitation element 10.

The conductive element 4 may be disposed on one or more layers of a printed wiring board (PWB), and in some example embodiments the conductive element 4 may be hidden from view. The feed 16 may also be disposed on one or more layers of a PWB.

The length d2 of the aperture may be less than 10 mm and the width w2 may be less than 4 mm.

A radio-frequency current flowing around the current path 24 excites an electric current in the planar conductive element 4 via Magnetic Field Strength (H) coupling. This enables the planar conductive element 4 to operate as an antenna radiator.

FIGS. 3A, 3B, 3C and 3D illustrate an example of how the excitation element 10 may be fed by a feed 16 such that electric current flows in the current path 24. In these figures the feed 16 is an indirect feed.

FIG. 3A is a perspective view, FIG. 3B is a side cross-sectional view, FIG. 3C is a top view of an upper layer and FIG. 3D is a top-view of a lower layer The indirect feed element 16 is adjacent to but separated from the thin elongate portion 20 and separated from the conductive planar element 4. The indirect feed element 16 lies within the lower layer (FIG. 3D) and the thin elongate portion 20 and the conductive planar element 4 lie in the upper layer (FIG. 3C).

Energy is transferred between the feed element 16 to the thin elongate portion 20 via electric (E) field coupling. This coupling may be controlled by controlling the amount of overlap between the feed element 16 and the thin elongate portion 20.

FIG. 3B illustrates that the conductive material 5 of the top layer that defines the interior aperture 12 and the thin elongate portion 20 is separated from conductive material 5' of the bottom layer that defines the feed 16 by a dielectric substrate 9.

The conductive material 5 is supported by (attached to) a top face 11A of the dielectric substrate 9.

The conductive material 5', which defines the indirect feed element 16, is supported by (attached to) a lower face 11B of the dielectric substrate 9.

The dielectric substrate 9 is substantially planar with opposing top and lower faces 11A, 11B.

Conductive material 5' is absent from an area 18 surrounding the feed element 16. The area 18 in this example is positioned below and substantially in correspondence with the interior aperture 12. It has a substantially rectangular perimeter in this example that corresponds in a large part to the perimeter of the interior aperture.

In this example the indirect feed element has an asymmetric T shape but it may have other shapes and configurations. It comprises an elongate portion 17 that extends parallel to the edge 7 and a transverse portion 19 that extends orthogonally to the elongate portion 17. The width of the elongate portion 17 may be substantially the same as the width w1 of the thin elongate portion 20.

The elongate portion 17 is positioned below and substantially in correspondence with the thin elongate portion 20. The elongate portion 17 extends for a length L2 along the elongate edge 7 of the planar conductive element 4 under the thin elongate portion 20 for part of the length of the thin elongate portion 20.

The length L2 of the portion 17 of the indirect feed element 16 is controlled to enable the apparatus 2 to operate as an antenna at at least a desired resonant frequency.

An optional conductive tab 28 may, in some embodiments, extend from the conductive material 5' that is separated from the indirect feed element 16 by the non-conductive area 18, into the area 18 towards but not to the indirect feed element 16. The conductive tab 28 extends for its length along the elongate edge 7 of the planar conductive element 4 under the thin elongate portion 20. The width of the conductive tab 28 may be substantially the same as the width w1 of the thin elongate portion 20.

The length of the conductive tab 28 may be controlled to enable the apparatus 2 to operate as an antenna at a desired resonant frequency.

FIG. 5 illustrates an alternative arrangement for providing a feed to the excitation element 10. In this example, the excitation element is on a single layer and the feed 16 is a direct, or galvanic, feed to the thin elongate portion 20. This direct feed may, for example, alternatively be provided by a core of a co-axial cable.

FIG. 6A, illustrates a variation of the apparatus 2 as illustrated in FIG. 1. This apparatus has dual-band operation. The apparatus 2 illustrated in FIG. 1 comprises a single excitation element 10, whereas the apparatus 2 of FIG. 6A comprises two excitation elements 10A, 10B.

The first excitation element 10A is similar to that described with reference to FIGS. 1 to 5. It is positioned at the left elongate edge 7A.

The second excitation element 10B is also similar to that described with reference to FIGS. 1 to 5, however, it is positioned at the right elongate edge 7B.

In other exemplary embodiments, at least one of the first and second excitation elements 10A, 10B may be disposed along any of the shorter edges 6.

The first excitation element 10A is positioned at a left side edge 7A of the conductive planar element 4 at a distance d1A from a top edge 6. The second excitation element 10A is positioned at a right side edge 7B of the conductive planar element 4 at a distance d1B from a top edge 6.

The first excitation element 10A and the second excitation element 10B are separately fed by separate radios, for example the first excitation element 10A is coupled to a Bluetooth (BT) radio (not illustrated in FIG. 6A) and the second excitation element 10B is coupled to a Global Positioning System (GPS) radio (not illustrated in FIG. 6A), and when fed result in the conductive planar element operating as a dual-band radiator of an antenna. In other exemplary embodiments, the first excitation element 10A may be coupled to a receiver circuit of a radio and the second excitation element 10B may be coupled to a transmitter circuit of the same radio, where the radio is configured to provide a common radio protocol, for example, EGSM.

FIG. 6B illustrates an example of the impedance and isolation of the antenna formed by the first excitation element 10A and the second excitation element 10B. It can be seen that there are two operational bandwidths that correspond with the Global Positioning System (GPS) requirement and the Bluetooth requirement, respectively. The isolation between the antennas formed is satisfactory.

FIG. 7A, illustrates a variation of the apparatus 2 as illustrated in FIG. 1. This apparatus has dual-band operation.

In this example, the excitation element 10' comprises a second non-conductive interior aperture 42 in the area of conductive material 5 and a second conductive elongate portion 40 is defined by a second gap 46, by at least a portion of the interior aperture 12 and by at least a portion of the second non-conductive interior aperture 42.

A single indirect feed 16 is provided. In this example it is used to feed the second elongate portion 40 rather than the elongate portion 20.

The second elongate portion 40 may be a thin elongate portion. The elongate portion 20 may be a thin elongate portion.

The apparatus 2 therefore comprises: a conductive planar element 4 that comprises an elongate area of conductive material 5 defined by a plurality of edges including at least one elongate edge 7 and a feed element 16. The conductive planar element 4 comprises a first interior aperture 12 in the area of conductive material 5 and a first elongate portion 20 defined by a gap 14 at the elongate edge 7 of the conductive planar element 4 and by at least a portion of the interior aperture 12. The conductive planar element 4 also comprises a second interior aperture 42 in the area of conductive material 5 and a second elongate portion 40 defined by a second gap 46, by at least a portion of the first interior aperture 12 and by at least a portion of the second interior aperture 42.

The excitation element 10' comprises a first interior aperture 12 in the conductive material 5 of the conductive planar element 4. The first interior aperture 12 is positioned adjacent to the left side edge 7 and is an aperture that is wholly within the boundary of the conductive planar element 4.

The excitation element 10' also comprises a second interior aperture 42 in the conductive material 5 of the conductive planar element 4. The second interior aperture 42 is positioned adjacent to the first interior aperture 12 and is wholly within the boundary of the conductive planar element 4.

A first elongate portion 20 of conductive material 5 has a width w1 defined by the left elongate edge 7 of the conductive planar element 4 and by at least a portion of the interior aperture 12 and a length L1 defined by a gap 14 that extends from the interior aperture 12 through the conductive material 5 to the edge 7. The elongate portion 20, in this example, has a width w1 less than ⅕th the length L1. In this example, the width w1 is less than 1 mm.

A second elongate portion 40 of conductive material 5 has a width w1 defined by the right perimeter of the first interior aperture 12 and by at least a portion of the second interior aperture 42 and a length L1 defined by a gap 46 that extends from the second interior aperture 42 through the conductive material 5 to the first interior aperture 12. The second elongate portion 40, in this example, has a width w1' less than ⅕th the length L1'. In this example, the width w1' is less than 1 mm. The width and/or length and/or position of the gap 14, 46 may be the same or different for the two elongate portions 20, 40.

The first interior aperture 12 is elongate. In this example it has a substantially rectangular perimeter having a length d2 and a width w2. The aperture has elongate sides that are parallel to the elongate sides 7 of the conductive planar element 4. The substantially rectangular perimeter has an outwardly extending notch to form the gap 14. The gap 14 prevents a galvanic/direct electric current flowing along the elongate edge 7 of the conductive planar element 4. The gap 14 may be less than 2 mm. The position of the gap 14 controls the length L1 of the elongate portion 20. In the illustrated example, the gap 14 is positioned to maximize the length L1 of the thin elongate portion 20. The gap 14 may be positioned anywhere along the length of the elongate portion 20 in other exemplary embodiments.

The second interior aperture 42 is elongate. In this example it has a substantially rectangular perimeter having a length d2' and a width w2'. The aperture has elongate sides that are parallel to the elongate sides 7 of the conductive planar element 4. The substantially rectangular perimeter has an outwardly extending notch to form the second gap 46. The gap 46 prevents a galvanic/direct electric current flowing along the conductive material located between the first and second interior apertures 12, 42. The gap 46 may be less than 2 mm. The position of the gap 46 controls the length L1 of the second elongate portion 40. In the illustrated example, the gap 46 is positioned to maximize the length L1 of the elongate portion 20. The gap 46 may be positioned anywhere along the length of the elongate portion 40 in other exemplary embodiments.

In the illustrated example, the width w2' and length d2' of the second interior aperture 42 are the same as the width w2 and length d2 of the first interior aperture 12. However, in other implementations, the width w2' and/or length d2' of the second interior aperture 42 may differ from the width w2 and length d2 of the first interior aperture 12.

The first interior aperture 12 is parasitically fed by the second interior aperture 42 (which is fed). The width of w1' can be controlled to provide the required coupling.

Radio frequency electric current path loops are formed around the rectangular perimeter of the first interior aperture 12 and around the rectangular perimeter of the second interior aperture 42. The loops are closed across the gaps 14, 46 either by the inherent capacitance of the gaps 14, 46 (if small enough) or by the use of one or more reactive elements 30, 44 to bridge the gap 14.

A radio-frequency current flowing around the different current paths excites different electric currents in the planar conductive element 4 via Magnetic Field Strength (H) coupling. The different electric currents have different resonant frequencies and represent different modes excited in the conductive element 4. By locating an excitation element 10, 10' at a specific location of the conductive element 4 where there is a peak in the H-field (magnetic current) the excitation element can excite the currents in the conductive element 4 so that there is an optimal excitation and the conductive element 4 radiates efficiently. The location of the peak magnetic current(s) is frequency dependent and also varies dependent on the shape and size of the conductive element 4. This enables the planar conductive element 4 to operate as a dual-band antenna radiator as illustrated in FIG. 7B.

As described previously with reference to FIG. 2B, a gap may be bridged by a reactive element. In the illustrated example, the first gap 14 is bridged by a first reactive element 30 and the second gap 46 is bridged by a second reactive element 44.

The first and second reactive values typically have different complex impedances.

The first reactive element 30 bridging the gap 14 may be capacitive and/or inductive. It may, for example comprise one or more lumped components. In the illustrated example, the first reactive element 30 is a lumped capacitor.

The second reactive element 44 bridging the gap 46 may be capacitive and/or inductive. It may, for example comprise one or more lumped components. In the illustrated example, the second reactive element 44 is a lumped capacitor.

Alternatively, at least one of the first and second reactive elements 30, 44 may comprise distributed components. For example, a capacitive reactance may be formed by planar microstrip elements, for example a planar microstrip element may be an interdigital capacitor or an edge coupled microstrip as is known in the art. Such distributed reactive elements may be formed by using other radio frequency and microwave forms such as stripline where stripline elements are provided between layers of a multilayer substrate, for example a printed wiring board. It will be apparent to the skilled person that all of these radio frequency and microwave techniques may be utilized to form reactive components.

The feed element 16 in the illustrated example is the same as illustrated in FIGS. 3A to 3D and this description is also applicable to this embodiment. However, it should be noted that in this example, the indirect feed element 16 corresponds with the second thin elongate portion 40 rather than the first thin elongate portion 20.

FIG. 8 illustrates an example of an electronic device 50 that uses the apparatus 2 to provide one or more antennas 62.

The device 50 may, for example, comprise user input circuitry 52 (e.g. one or more of a touch screen, keys, buttons, mouse etc) and user output circuitry 54 (e.g. one or more of a display, an audio output, etc).

The device 50 may be controlled by one or more processors 56 which may access one or more memories 58.

The device 50 may also comprise one or more radio transceivers, receivers or transmitters 60 that convert digital data to an analogue current/voltage suitable for feeding an antenna.

A transceiver is connected to an antenna 62 that enables reception and/or transmission of radio waves within an operational frequency band.

In the event that a single transceiver is used, then any of the embodiments described with reference to FIGS. 1 to 5 may be suitable.

In the event that multiple transceivers are used, then any of the multi-band embodiments described with reference to FIGS. 6-7 may be suitable.

The manufacture of an electronic device 50 typically involves that attachment of different modules to a printed wiring board to create an operational device. A printed wiring board may be used as the conductive planar element 4.

The printed wiring board may, for example, provide a ground plane 4 with an aperture 12 at a position adjacent to a longer edge 7 of the ground plane 4 and spaced from a shorter edge 6 of the ground plane 4 and a feed element 16 configured to feed a closed-loop electric current path 24 comprising portions 22 of the ground plane 4 that define the aperture 12 to enable radio wave radiation by the ground plane 4.

The electronic device 50 may, for example be a mobile device, a hand-portable device or similar. It may be a personal device that is designed to be carried by a human user, for example, in a hand-bag or shirt-pocket. The electronic device may provide different functionality in addition to radio reception and/or radio transmission. It may, for example, operate as one or more of a mobile cellular telephone, a satellite positioning system, a wireless communication device, a personal media player etc.

As used here 'module' refers to a unit or apparatus that excludes certain parts/components that would be added by an end manufacturer or a user. The apparatus 4 may be a module.

Although embodiments of the present invention have been described in the preceding paragraphs with reference to various examples, it should be appreciated that modifications to the examples given can be made without departing from the scope of the invention as claimed.

It should be appreciated that the term 'feed' or 'fed' in the technical field of radio antennas has a well understood meaning to a person of ordinary skill in this technical art. A 'feed' is the route by which radio frequency signals travel between radio frequency circuitry and an antenna. The term 'feed' does not imply a particular direction of travel for the radio frequency signal. The feed is therefore used to provide radio frequency signals to the antenna when the antenna is transmitting and is used to provide radio frequency signals from the antenna when the antenna is receiving.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An apparatus comprising:

a conductive element comprising an area of conductive material defined by a plurality of edges including at least a first edge wherein the conductive element comprises:

a first interior aperture in the area of conductive material and a first elongate portion defined by a first gap at the first edge of the conductive element and by at least a portion of the interior aperture; and a second interior aperture in the area of conductive material and a second elongate portion defined by a second gap, by at least a portion of the first interior aperture and by at least a portion of the second interior aperture, and further comprising at least one of a lumped reactive element and a distributed reactive element bridging the first gap; and a feed element associated with the second elongate portion, wherein the first interior aperture is positioned adjacent to the first edge and is an aperture that is wholly within a boundary of the conductive element and the second interior aperture is positioned adjacent to the first interior aperture and is wholly within the boundary of the conductive element, and wherein the first interior aperture is parasitically fed by the second interior aperture.

2. The apparatus according to claim 1, wherein the feed element is an indirect feed element adjacent to but separated from the second elongate portion and separated from the conductive element.

3. The apparatus according to claim 1, further comprising at least one of a lumped reactive element and a distributed reactive element bridging the second gap.

4. The apparatus according to claim 1, wherein the first interior aperture and the second interior aperture are both elongate and substantially parallel.

5. The apparatus according to claim 1, wherein the first interior aperture and the second interior aperture are both elongate and have substantially the same length.

6. The apparatus according to claim 1, wherein the first interior aperture and the second interior aperture are both elongate and have substantially the same width.

7. The apparatus according to claim 1, wherein the second interior aperture has a substantially rectangular perimeter that has an outwardly extending notch through to the first interior aperture that forms the second gap.

8. The apparatus according to claim 1, wherein one or more of the first gap and the second gap are positioned to maximize a length of one or more of the first elongate portion and the second elongate portion.

9. The apparatus according to claim 1, wherein the conductive element is configured as a ground plane for a communications device.

10. The apparatus according to claim 1, wherein the conductive material is supported by a substantially planar dielectric support having opposing first and second faces and wherein the first face supports the conductive material having the first interior aperture, the first elongate portion, the second interior aperture, and the second elongate portion, and wherein the second face provides the feed element.

11. The apparatus according to claim 10, wherein the second face supports conductive material that is substantially absent in an area corresponding to the second interior aperture except for the feed element and a conductive tab, wherein at least a portion of the feed element and the conductive tab are positioned to correspond with the second elongate portion.

12. The apparatus according to claim 11, wherein the length of the conductive tab is controlled to enable the apparatus to operate as an antenna at least at a desired resonant frequency.

13. The apparatus according to claim 10, wherein the length of the portion of the feed element that corresponds with the elongate portion is controlled to enable the apparatus to operate as an antenna at least at a desired resonant frequency.

14. The apparatus according to claim 1, wherein the conductive element is a printed wiring board.

15. The apparatus according to claim 1, wherein the conductive element is configured as a radiator that enables the apparatus to operate as a dual-band antenna.

16. The apparatus according to claim 1, wherein the feed element is a direct feed element configured to couple to the second elongate portion.

17. An electronic device comprising:

a conductive element comprising an area of conductive material defined by a plurality of edges including at least a first edge wherein the conductive element comprises:

a first interior aperture in the area of conductive material and a first elongate portion defined by a first gap at the first edge of the conductive element and by at least a portion of the interior aperture; and a second interior aperture in the area of conductive material and a second elongate portion defined by a second gap, by at least a portion of the first interior aperture and by at least a portion of the second interior aperture, and further comprising at least one of a lumped reactive element and a distributed reactive element bridging the first gap; and a feed element associated with the second elongate portion, wherein the first interior aperture is positioned adjacent to the first edge and is an aperture that is wholly within a boundary of the conductive element and the second interior aperture is positioned adjacent to the first interior aperture and is wholly within the boundary of the conductive element, and wherein the first interior aperture is parasitically fed by the second interior aperture.

* * * * *